US011242706B2

(12) United States Patent
Peer et al.

(10) Patent No.: US 11,242,706 B2
(45) Date of Patent: Feb. 8, 2022

(54) REMOVABLE DAMPING MECHANISM AND CABINET HINGE ASSEMBLY INCLUDING SAME

(71) Applicant: Grass America Inc., Kernersville, NC (US)

(72) Inventors: Manfred Peer, Walkertown, NC (US); Daniel L. Moss, High Point, NC (US); Georg Domenig, Kernersville, NC (US)

(73) Assignee: Grass America Inc., Kernersville, NC (US)

( * ) Notice: Subject to any disclaimer, the term of this patent is extended or adjusted under 35 U.S.C. 154(b) by 0 days.

(21) Appl. No.: 16/935,669

(22) Filed: Jul. 22, 2020

(65) Prior Publication Data

US 2021/0032919 A1 Feb. 4, 2021

Related U.S. Application Data

(60) Provisional application No. 62/880,205, filed on Jul. 30, 2019.

(51) Int. Cl.
*E05F 3/00* (2006.01)
*E05F 5/00* (2017.01)
(Continued)

(52) U.S. Cl.
CPC ..... *E05F 5/006* (2013.01); *E05D 7/123* (2013.01); *E05D 11/0054* (2013.01); *E05Y 2201/11* (2013.01); *E05Y 2201/258* (2013.01); *E05Y 2201/46* (2013.01); *E05Y 2201/474* (2013.01); *E05Y 2900/20* (2013.01)

(58) Field of Classification Search
CPC ..... E05Y 2900/20; E05Y 2900/202; E05Y 2900/204; E05Y 2900/208; E05Y 2201/20; E05Y 2201/21; E05Y 2201/261; E05Y 2201/11; E05Y 2201/258; E05Y 2201/46; E05Y 2201/474; E05F 5/006; E05F 5/02; E05F 5/027; E05D 11/0054; E05D 11/1021; E05D 11/1042; E05D 11/105; E05D 11/1064; E05D 7/04; E05D 7/0407;
(Continued)

(56) References Cited

U.S. PATENT DOCUMENTS 8,505,165 B2 8/2013 Domenig et al.
8,561,262 B1 * 10/2013 Liang ..... E05F 5/04 16/286
(Continued)

*Primary Examiner* — Chuck Y Mah
(74) *Attorney, Agent, or Firm* — Burr & Brown, PLLC

(57) ABSTRACT

A damping mechanism is provided, including a damper housing, a damping assembly provided within the damper housing, and a damper cover assembly fitted to at least a portion of the damper housing. The damper cover assembly includes a damper cover and at least one connection member attached thereto. A recess is provided on a rearward side of the damper cover, and at least one receptacle is provided, defining an opening on a bottom surface of the damper cover and being adapted to receive and retain therein at least a portion of the at least one connection member of the damper cover assembly. The recess of the damper cover and the connection member of the damper cover assembly are cooperatively adapted to provide a mechanical connection between the damping mechanism and a hinge cup of a hinge assembly in a removable manner.

19 Claims, 6 Drawing Sheets

(51) Int. Cl.
*E05D 11/00* (2006.01)
*E05D 7/12* (2006.01)

(58) Field of Classification Search
CPC ..... E05D 7/123; E05D 7/125; E05D 3/142; Y10T 16/5383; Y10T 16/304; Y10T 16/54029
See application file for complete search history.

(56) References Cited

U.S. PATENT DOCUMENTS 8,650,711 B1 * 2/2014 Chen ..... E05F 5/006 16/54
8,661,620 B2 * 3/2014 Brunnmayr ..... E05F 5/006 16/327
8,667,647 B2 * 3/2014 Brunnmayr ..... E05D 11/08 16/327
9,163,447 B1 * 10/2015 Liang ..... E05F 3/20
9,611,682 B2 4/2017 Forster et al.
10,428,896 B2 * 10/2019 Zimmer ..... F16F 9/19
2008/0092333 A1 * 4/2008 Migli ..... E05F 5/006 16/221
2011/0291538 A1 * 12/2011 Brunnmayr ..... E05F 5/006 312/326
2012/0126677 A1 * 5/2012 Ahlfeld ..... E05F 5/006 312/326
2013/0000075 A1 * 1/2013 Forster ..... E05F 5/006 16/84
2013/0145580 A1 * 6/2013 Brunnmayr ..... E05F 5/006 16/277
2013/0160242 A1 * 6/2013 Brunnmayr ..... E05F 5/04 16/286
2014/0345081 A1 * 11/2014 Salice ..... E05F 5/006 16/50
2014/0352111 A1 * 12/2014 Ng ..... E05F 5/02 16/286
2016/0138319 A1 * 5/2016 Wu ..... E05D 7/0415 16/50
2018/0100339 A1 * 4/2018 Kirenci ..... E05F 3/20

* cited by examiner

REMOVABLE DAMPING MECHANISM AND CABINET HINGE ASSEMBLY INCLUDING SAME

BACKGROUND OF THE INVENTION

1. Field of the Invention

The present invention relates to a damping mechanism having structural features that enable the damping mechanism to be removably coupled to a hinge cup of a cabinet hinge assembly. The damping mechanism can be added to or removed from cabinet hinge assemblies as desired, without requiring industrial force or equipment, and without damaging the damping mechanism or the associated hinge hardware.

2. Background of the Invention

In the context of cabinets and door hinge assemblies, damping mechanisms that are provided in conjunction with hinge assemblies that have hinge cups are known in the industry, and are widely used. These damping (or damper) mechanisms operate in conjunction with cabinet hardware to control the opening and or closing motion speed of the doors in order to prevent slamming or damage. Since damping mechanisms are so widely used, it is not uncommon for most hinge assemblies to be provided with a damper mechanism. Typically, these damping mechanisms are pre-installed in the hinge cups of the hinge hardware by the hardware manufacturer and/or the cabinet manufacturer. Examples of such damping mechanisms are shown in U.S. Pat. Nos. 8,505,165 and 9,611,682.

The '682 patent discloses a damper mechanism that corresponds to the damper mechanism 700 shown in FIG. 1. The damper mechanism 700 includes a damper housing 3, a damping assembly 2 provided within the damper housing 3, and a damper cover 1' fitted to a portion of the damper housing 3. The damper cover 1' is a unitary, substantially rigid plastic member, typically formed as a single piece by injection molding or the like. The upper surface 103 of the damper cover 1 includes a recess 103*a*, which is situated in a substantially central portion of the arcuate rearward side 102, and which defines a step portion 102*b* between a plane of the upper surface 103 and a plane of a rearward side surface 102*a* of the damper cover (which extends in the thickness direction). The damper cover 1' also includes permanent protrusions 112 that are integrally formed as part of the frontward side surface 101*a* thereof.

In order to assemble the damper mechanism 700 and the associated hinge hardware, the damper mechanism 700 is press-fit into the hinge cup 4 using a large, hydraulic ram to force forward a protrusion part (see, e.g., protrusion 41*a* in FIG. 6) formed on the inner surface of hinge cup 4 into the recess 103*a*/step 102*b* to forcibly form part of the connection between the damping mechanism 700 and the hinge cup 4. The protrusions 112 are likewise forcibly press-fit into openings in the hinge cup 4 during this process. Since this assembly process cannot be accomplished without the aid of significant force and industrial tools, the assembly process is limited to hardware/hinge manufacturers and cabinet manufacturers with suitable tools and expertise.

While it may be more convenient for cabinet manufactures and installers to use hardware kits including damping mechanisms, or hardware that is pre-loaded with a damper mechanism by the hardware manufacturer before installation in a cabinet setting, the damping mechanism increases the cost of the respective hinge hardware assembly. This can also be an issue when it is not necessary for every hinge on every door be provided with a damping mechanism (to prevent over-damping, as noted above), particularly for larger doors that have a plurality of hinges thereon. Once the damper mechanism 700 is positioned in the hinge cup 4, damper mechanism 700 is essentially permanently positioned, and it is not possible to remove the damper mechanism 700 by hand without damaging the damper mechanism 700 or the hinge cup 4.

Indeed, hinges provided with these types of damper mechanisms 700 will always have the damper mechanism therein, and if less damping is desired because an over-damped door closes much too slowly, the entire hinge assembly must be removed and an entirely different hinge assembly (without a damping mechanism) must installed on the cabinet instead. Accordingly, the cabinet makers and installers would need to remove and re-install hinge assemblies, or buy a variety of different hinge assemblies depending on the various door sizes, number of hinges, etc. in order to accommodate provide doors that exhibit an appropriate amount of damping. This process is tedious and costly. To date, there has not been a damping mechanism that can be inserted into and removed from the hinge cup by hand without damaging the associated parts.

In addition, the increased popularity of do-it-yourself installation also calls for the provision of a stand-alone damper mechanism that can be sold as an after-market product and easily hand-installed, in situ, in existing cabinets whose hardware may lack damper mechanisms, and which can be readily hand-removed from selected hinge assemblies by any user if the level of damping is not required.

In view of the drawbacks associated with the current damping mechanisms, it is desired to provide a more cost effective and efficient damper mechanism for a hinge assembly that can be added to select hinge assemblies by any given user (hardware or cabinet manufacturer, installer or homeowner) to provide the desired level of damping action without requiring substantial insertion force and/or industrial tools, and which can be readily removed from a hinge assembly, as needed, without causing damage to the parts and without requiring substantial force/industrial tools. Such a product has not been known heretofore.

SUMMARY OF THE INVENTION

The present invention has been made in order to overcome the drawbacks of the prior art damping mechanisms and hinge assemblies discussed above.

According to one embodiment of the present invention, a damping mechanism is provided, including a damper housing, a damping assembly provided within the damper housing, and a damper cover assembly fitted to at least a portion of the damper housing. The damper cover assembly includes a damper cover and a connection member attached thereto. The damper cover has a recess provided on a rearward side thereof, and at least one receptacle defining an opening on a bottom surface of the damper cover assembly. The at least one receptacle of the damper cover is adapted to receive and retain therein at least a portion of the connection member of the damper cover assembly. The recess of the damper cover and the connection member of the damper cover assembly are cooperatively adapted to provide a mechanical connection between the damping mechanism and a hinge cup in a removable manner.

Preferably, the damper cover has an arcuate rearward side connecting two laterally opposed ends of a linear frontward side, an upper surface defining a plane extending in a first direction and an opposed lower surface extending in the first direction that is spaced apart from the first surface in a second direction that is substantially perpendicular with respect to the first direction. The upper surface of the damper cover includes the recess, which is situated in a substantially central portion of the arcuate rearward side and which defines a step portion between the plane of the upper surface and a plane of a rearward surface the damper cover. The at least one receptacle extends in a second direction, which is substantially perpendicular with respect to the first direction, from an opening formed in the bottom surface toward a terminal end situated in an interior portion of the damper cover. The at least one receptacle is situated proximate at least one of the laterally opposed ends of the frontward side of the damper cover, wherein the at least one receptacle is adapted to receive and retain at least a portion of the at least one connection member of the damper cover assembly.

According to one aspect of the present invention, the at least one connection member of the damper cover assembly comprises at least one magnet. The magnet(s) are press-fit so as to be situated within the receptacle(s) of the damper cover assembly. When the damping mechanism is press-fit into the hinge cup, the magnets of the damper cover assembly provide a magnetic connection between the damping mechanism and the metal hinge cup. In addition, a physical connection between the damping mechanism and the hinge cup is further made between the recess/step in the damper cover that engages a corresponding protrusion on the inner surface of the hinge cup when the damping mechanism is press-fit therein. This configuration enables the damping mechanism to be readily inserted into the hinge cup without the need to the use of tools, which significantly improves the ease of installation and enables end-users of various sophistication to add a damping mechanism to an existing hinge cup (pre-installation), or to a hinge cup in an installed hinge assembly, as desired.

Conversely, if desired, a damping mechanism including magnetic connection member(s) as part of the damper cover assembly can be readily removed from the hinge cup using minimal tools (i.e., a simple nail needle, flat head screwdriver or other prying object) and minimal force (i.e., simple hand force), without causing the destruction of the hinge cup or the damping mechanism, and without causing damage to the magnets of the damper cover assembly themselves. If re-use of the damping mechanism is desired, the same damping mechanism can be used again, or if necessary, new magnets can be inserted into the receptacles of the damper cover and used to again help provide secure coupling between the hinge cup and the damping mechanism in conjunction with the recess/step in the damper cover.

According to another aspect, the at least one connection member of the damper cover assembly comprises a flex-tab (clip). Preferably, the flex-tab comprises a first portion adapted to be received and retained in the receptacle, a second portion, spaced apart from the first portion, that abuts a front surface of the damper cover, and a third portion connecting the first and second portions in a direction that is parallel with respect to the first direction. The second portion of the flex-tab comprises a protrusion extending a distance away from the front surface of the damper cover in the first direction.

Preferably, the flex-tab is made from a resilient material, such as a plastic. Suitable examples of such a plastic material for the flex-tab include, but are not limited to, nylon, polypropylene and ABS. The flex-tab(s) are press-fit into the receptacles of the damper cover. When damping mechanism is press-fit into the hinge cup, a physical connection between the damping mechanism and the hinge cup is made between the recess/step in the damper cover that engages a corresponding protrusion on the inner surface of the hinge cup, and the protrusions of the flex-clips of the damper cover assembly engage a corresponding recess(es) on the hinge cup in a press-fit manner. In this way, the flex tab(s) aid in providing a secure connection between the damping mechanism and the hinge cup, but retain sufficient flexibility so that the damping mechanism can be readily inserted into the hinge cup by hand, without the need for tools. This significantly improves the ease of installation and enables end-users of various sophistication to install a damping mechanism to an existing hinge cup (pre-installation), or to a hinge cup in an installed hinge assembly, as desired.

Conversely, if desired, a damping mechanism including a damper cover assembly having flex-clip connection member(s) can also be readily removed by gently prying the damping mechanism away from the hinge cup using minimal tools (i.e., a simple prying tool like a nail needle or flat head screwdriver) and minimal force (i.e., simple hand force) without causing the destruction of the hinge cup or the damping mechanism. It may be possible to remove the damping mechanism without damaging the flex-clip(s) of the damper cover assembly, as well. In that case, when re-use of the damping mechanism is desired, it can be re-inserted and connected to the same or a different hinge cup, as desired. Since the flex-clip connection member inserts are small, plastic members that are easily manufactured at a low cost, and whose replacement does not pose a significant cost or efficiency factor, the flex-slip(s) of the damper cover assembly can be readily replaced if they are damaged upon removal. If re-use of the damping mechanism is desired, new flex-clip(s) can be inserted into the receptacles of the damper cover to again provide secure coupling between the hinge cup and the damping mechanism in conjunction with the recess/step in the damper cover.

It is further preferred that the at least one receptacle of the damper cover comprises two receptacles, each positioned proximate a respective one of the laterally opposed ends of the frontward side of the damper cover. In accordance with this aspect, the at least one connection member of the damper cover assembly preferably comprises two connection members, such as two magnets or two flex-tabs (clips).

According to another embodiment of the present invention, a hinge assembly for mounting a furniture door to a furniture housing is provided. The hinge assembly includes a fixation section installed on the furniture housing, a hinge cup affixed to the furniture door and pivotally connected to the fixation section, and a damping mechanism provided in the hinge cup and adapted to contact the fixation section to dampen the relative movement between the fixation section and the hinge cup as the furniture door closes on the furniture housing. The damping mechanism comprises an engagement mechanism adapted to mechanically couple the damping mechanism to the hinge cup in a removable manner.

Preferably, the damping mechanism comprises a damper housing, a damping assembly provided within the damper housing, and a damper cover assembly fitted to at least a portion of the damper housing. The damper cover assembly includes a damper cover and at least one connection member attached to the damper cover. The upper surface of the damper cover includes a recess that is situated in a substantially central portion of the arcuate rearward side and which defines a step portion between the plane of the upper surface and a plane of a rearward surface the damper cover. The damper cover includes at least one receptacle, extending in a second direction, which is substantially perpendicular with respect to the first direction, from an opening formed in the bottom surface toward a terminal end situated in an interior portion of the damper cover. The at least one receptacle of the damper cover is situated proximate at least one of the laterally opposed ends of the frontward side of the damper cover assembly, wherein the at least one receptacle is adapted to receive and retain therein at least a portion of the at least one connection member of the damper cover assembly.

The recess of the damper cover engages a corresponding protrusion provided on an inner surface of the hinge cup, and the at least one connection member of the damper cover assembly engages at least another portion of the hinge cup to cooperatively couple the damping mechanism to the hinge cup of the hinge assembly in a removable manner.

According to one aspect of the present invention, the at least one connection member of the damper cover assembly comprises a magnet, and according to another aspect, the at least one connection member of the damper cover assembly comprises a flex-tab. It is further preferred that the at least one receptacle of the damper cover comprises two receptacles, each positioned proximate a respective one of the laterally opposed ends of the frontward side of the damper cover. In accordance with this aspect, the at least one connection member of the damper cover assembly preferably comprises two connection members, such as two magnets or two flex-tabs.

DETAILED DESCRIPTION OF THE INVENTION

Figure 1:
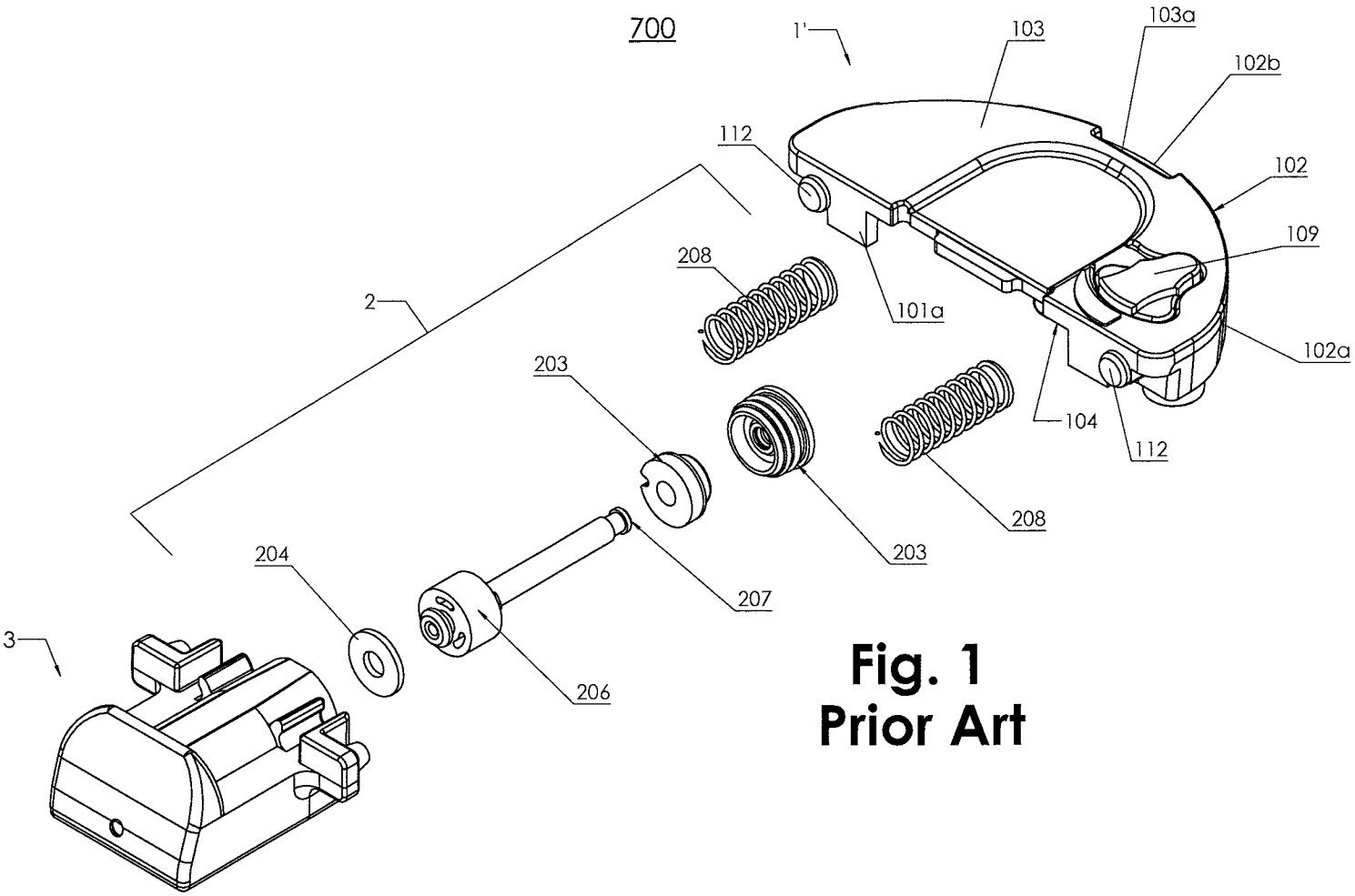
Fig. 1 Prior Art
FIG. 1 is an exploded perspective view of a prior art damping mechanism 700, which is not functionally removable once inserted into a hinge cup of a hinge assembly.
Figure 2:
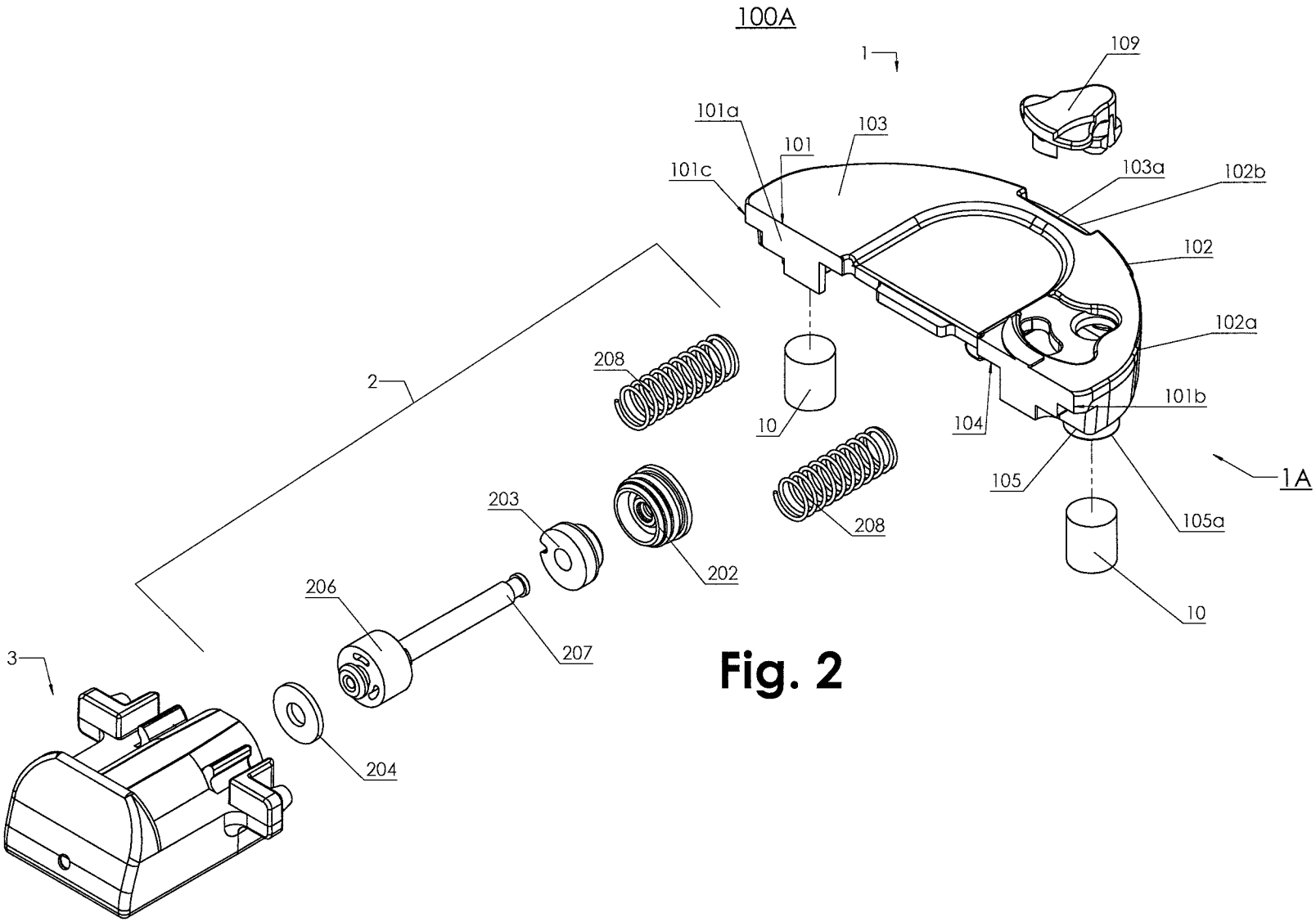
FIG. 2 is an exploded perspective view of a removable damping mechanism 100A according to one aspect of the present invention, including two magnetic connection members 10 of the damper cover assembly 1A.
Figure 3A:
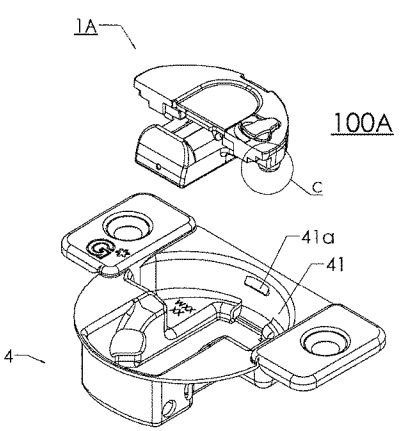
FIGS. 3(*a*)-3(*g*) are various views of the removable damping mechanism 100A shown in FIG. 2, removably coupled with a hinge cup 4 to comprise an assembly 500A (a hinge cup assembly), wherein FIG. 3(*a*) is a perspective pre-assembly view, FIG. 3(*b*) is a perspective view of the assembly 500A, FIG. 3(*c*) is an enlarged view of the receptacle 105 of the damper cover assembly 1A and the magnet 10 situated therein, FIG. 3(*d*) is a bottom view of the damper mechanism 100A, FIG. 3(*e*) is a top view of the assembly 500A, FIG. 3(*f*) is a front view of the assembly 500A, and FIG. 3(*g*) is a cross-sectional view of the assembly 500A taken through line A-A in FIG. 3(*f*)
Figure 3B:
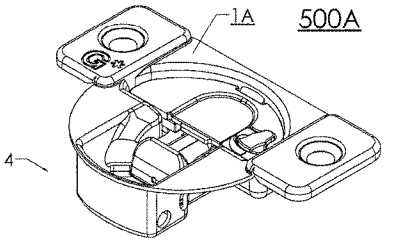
Figure 3C:
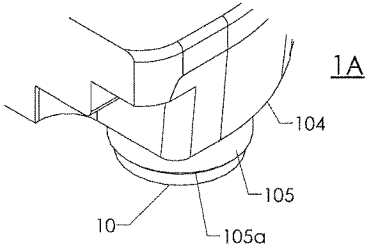
Figure 3D:
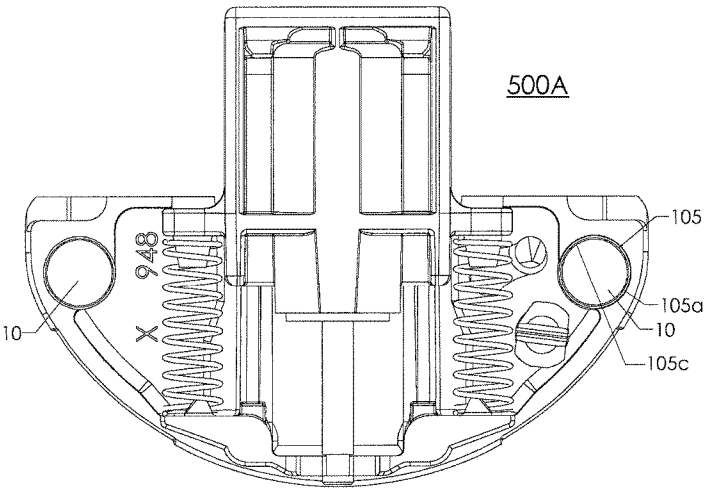
Figure 3E:
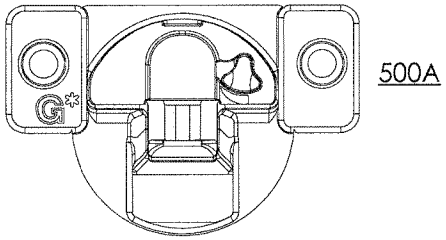
Figure 3F:
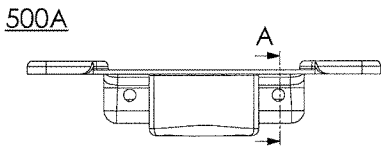
Figure 3G:
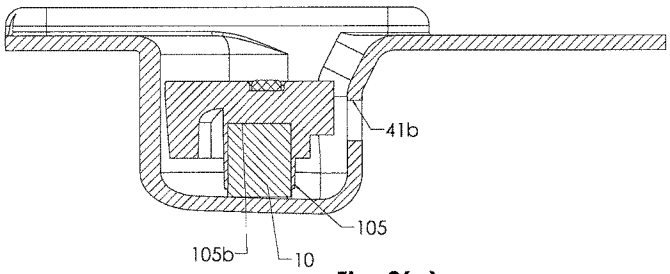
Figure 4:
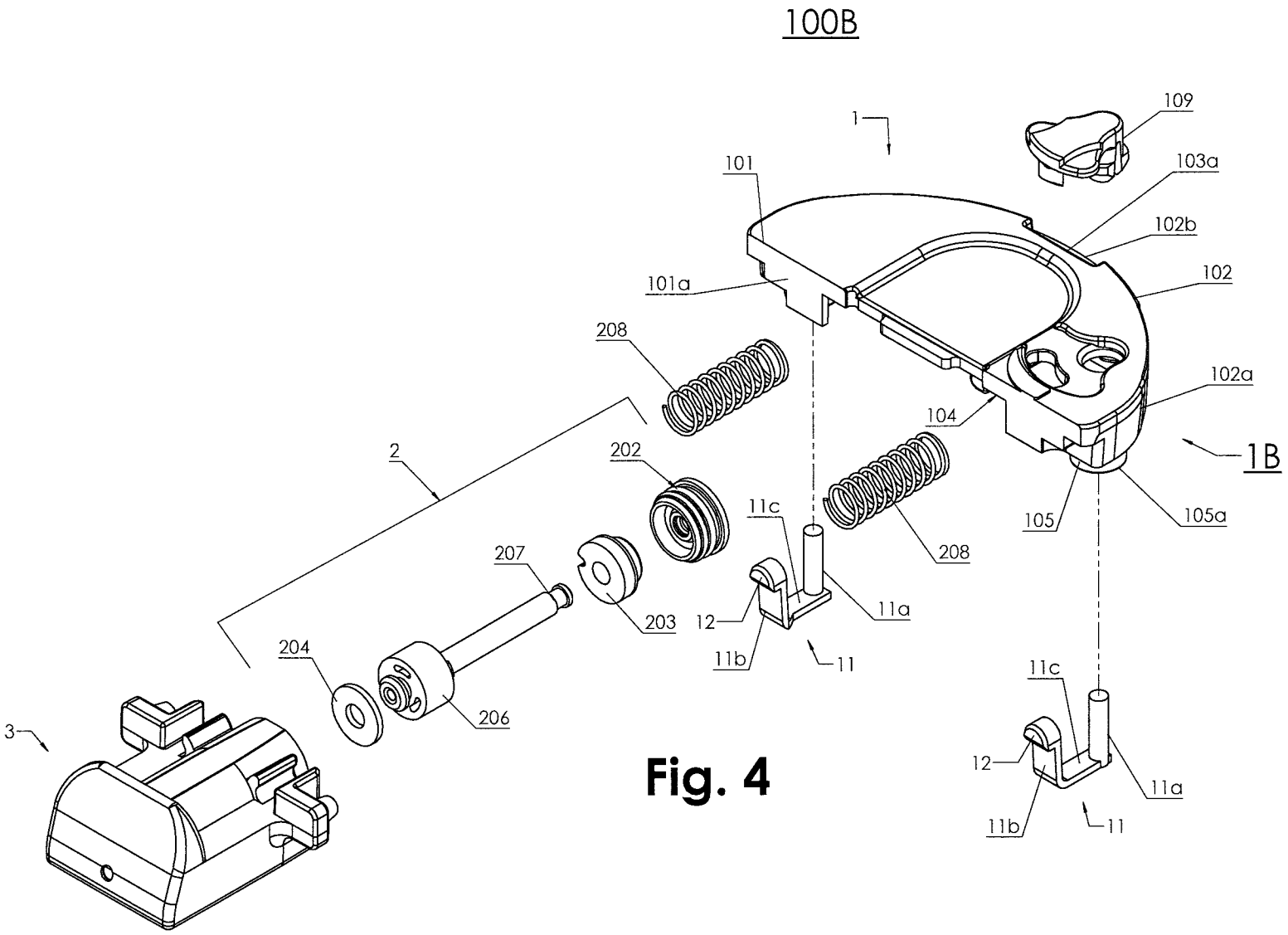
FIG. 4 is an exploded perspective view of a removable damping mechanism 100B according to another aspect of the present invention, including two flex-tab (clip) connection members 11 of the damper cover assembly 1B.
Figure 5A:
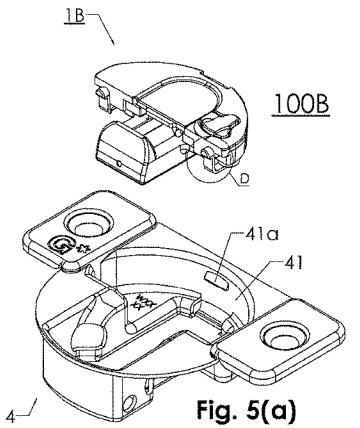
FIGS. 5(*a*)-5(*g*) are various views of the removable damping mechanism 100B shown in FIG. 4, removably coupled with a hinge cup 4 to comprise an assembly 500B (a hinge cup assembly), wherein FIG. 5(*a*) is a perspective pre-assembly view, FIG. 5(*b*) is a perspective view of the assembly 500B, FIG. 5(*c*) is an enlarged view of the receptacle 105 of the damper cover assembly 1B and the flex-tab 11 situated therein, FIG. 5(*d*) is a bottom view of the damper mechanism 100B, FIG. 5(*e*) is a top view of the assembly 500B, FIG. 5(*f*) is a front view of the assembly 500B, and FIG. 5(*g*) is a cross-sectional view of the assembly 500B taken through line B-B in FIG. 5(*f*)
Figure 5B:
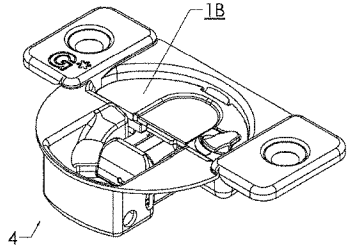
Figure 5C:
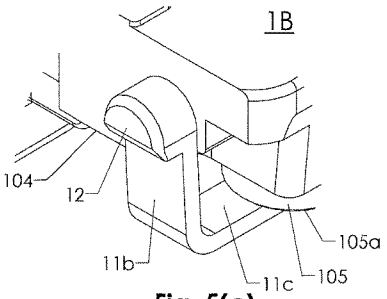
Figure 5D:
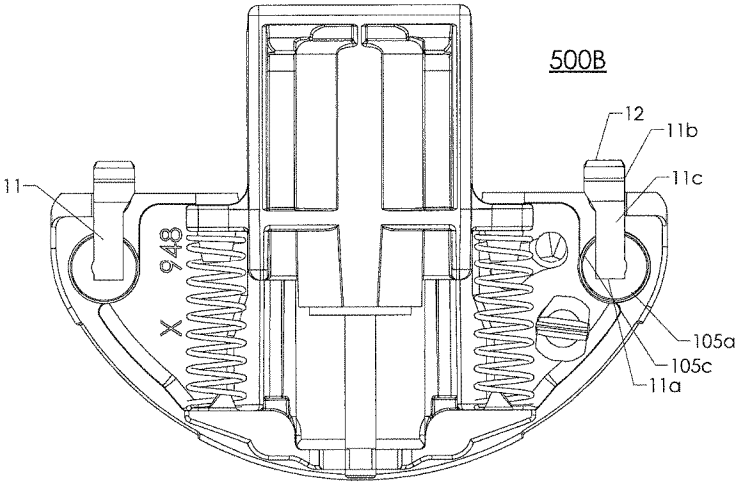
Figure 5E:
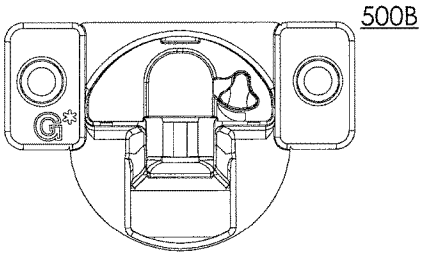
Figure 5F:
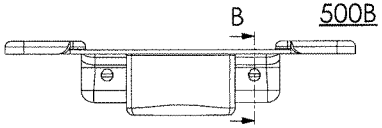
Figure 5G:
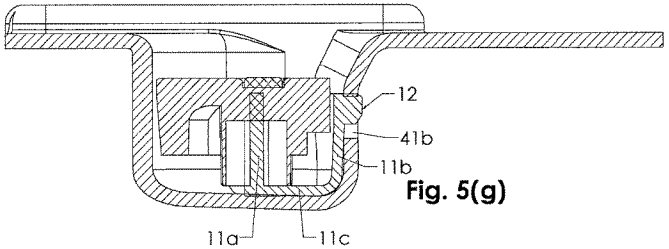

Like reference numbers have been used to designate like parts among the various drawings. As shown in FIGS. 2 and 4, the damping mechanisms 100A, 100B each include a damper housing 3, a damping assembly 2 provided within the damper housing 3, and a damper cover assembly 1A, 1B, including a damper cover 1 and a connection members 10 or 11, fitted to at least a portion of the damper housing 3.

The damper cover 1 has an arcuate rearward side 102 connecting two laterally opposed ends 101*c*, 101*b* of a linear frontward side 101*a*, an upper surface 103 defining a surface plane extending in a first direction (i.e., horizontal). The damper cover 1 also has an opposed lower surface 104 defining a surface plane extending in the first direction, and which is spaced a distance apart from the upper surface 103 in a second direction (thickness/vertical direction) that is substantially perpendicular with respect to the first direction.

The upper surface 103 of the damper cover 1 includes a recess 103*a*, which is situated in a substantially central portion of the arcuate rearward side 102, and which defines a step portion 102*b* between the plane of the upper surface 103 and a plane of a rearward side surface 102*a* of the damper cover 1 (which extends in the second/thickness direction). When the damping mechanism 110A, 100B is press-fit into the hinge cup 4, the recess 103*a*/step 102*b* receives a corresponding protrusion 41*a* from the inner surface 41 of the hinge cup 40 (see, e.g., FIGS. 3 and 5). This forms part of the connection between the damping mechanism 100A, 100B and the hinge cup 4.

The damper cover 1 includes least one receptacle 105 that extends in the second direction from an opening 105*a* formed in the bottom surface 104 toward a terminal end 105*b* situated in an interior portion of the damper cover assembly 1. Preferably, and as shown in the accompanying drawings, the at least one receptacle 105 of the damper cover 1 comprises two receptacles 105, each positioned proximate a respective one of the laterally opposed ends 101*c*, 101*b* of the frontward side 101 of the damper cover 1. The at least one receptacle 105 is adapted to receive and retain (press-fit) at least a portion of the connection member 10 or 11 of the damper cover assembly 1A, 1B to help secure the removable connection between the damping mechanism 100A, 100B and the hinge cup 4.

The at least one connection member of the damper cover assembly 1A comprises a magnet 10, and the at least one connection member of the damper cover assembly 1B comprises a flex-tab (clip) 11. Preferably, the at least one connection member of the damper cover assembly 1A, 1B preferably comprises two connection members, such as two magnets 10 or two flex-tabs 11. The recess/step 103*a*/102*b* of the damper cover 1 and the respective connection members (10 or 11) of the damper cover assembly 1A, 1B together define an engagement mechanism that is cooperatively adapted to provide a mechanical connection between the respective damping mechanisms 100A, 100B and a hinge cup 4 (see, e.g., FIGS. 3, 5 and 6) in a removable manner.

As shown in FIGS. 2 and 3, the connection member 10 of the damper cover assembly 1A of the damping mechanism 100A is a magnet having a substantially cylindrical shape to be accommodated within the receptacle 105 of the damper cover assembly 1 in a press-fit manner. The shape of the magnet 10 is not critical, so long as the outer diameter and cross-sectional shape enable the magnet 10 to be sufficiently received and retained within the respective receptacles 105.

When the damping mechanism 100A is press-fit into the hinge cup 4 (see, e.g., FIGS. 3 and 6), the magnets 10 (proximate the exposed ends thereof) of the damper cover assembly 1A engage the metallic inner surface 41 of the hinge cup 4 to provide a magnetic connection therebetween.

As shown in FIGS. 4 and 5, for example, the connection member 11 of the damper cover assembly 1B of the damping mechanism 100B is a flex-tab having a first portion 11*a* that is adapted to be received and retained (press-fit) in the receptacle 105 of the damper cover assembly 1, a second portion 11*b*, spaced apart from the first portion, that abuts the frontward side surface 101*a* of the damper cover 1, and a third portion 11*c* connecting the first and second portions 11*a*, 11*b* in a direction that is parallel with respect to the first direction. The second portion 11*b* of the flex-tab 11 comprises a protrusion 12 extending a distance away from the frontward side surface 101 of the damper cover 1 in the first direction. When the damping mechanism 100B is press-fit into the hinge cup 4, the protrusion 12 of the flex tab 11 of the damper cover assembly 1B engages a corresponding recess 41*b* in the hinge cup 4 (see, e.g. FIG. 5(*g*)).

The flex-tab 11 of the damper cover assembly 1B is preferably a unitary body made of a plastic material, such as nylon, by an injection molding process. The flex-tab 11 of the damper cover assembly 1B thereby exhibits a spring-like resiliency, which enables the insertion and removal of the damping mechanism 100B from the hinge cup 4.

Figure 6:
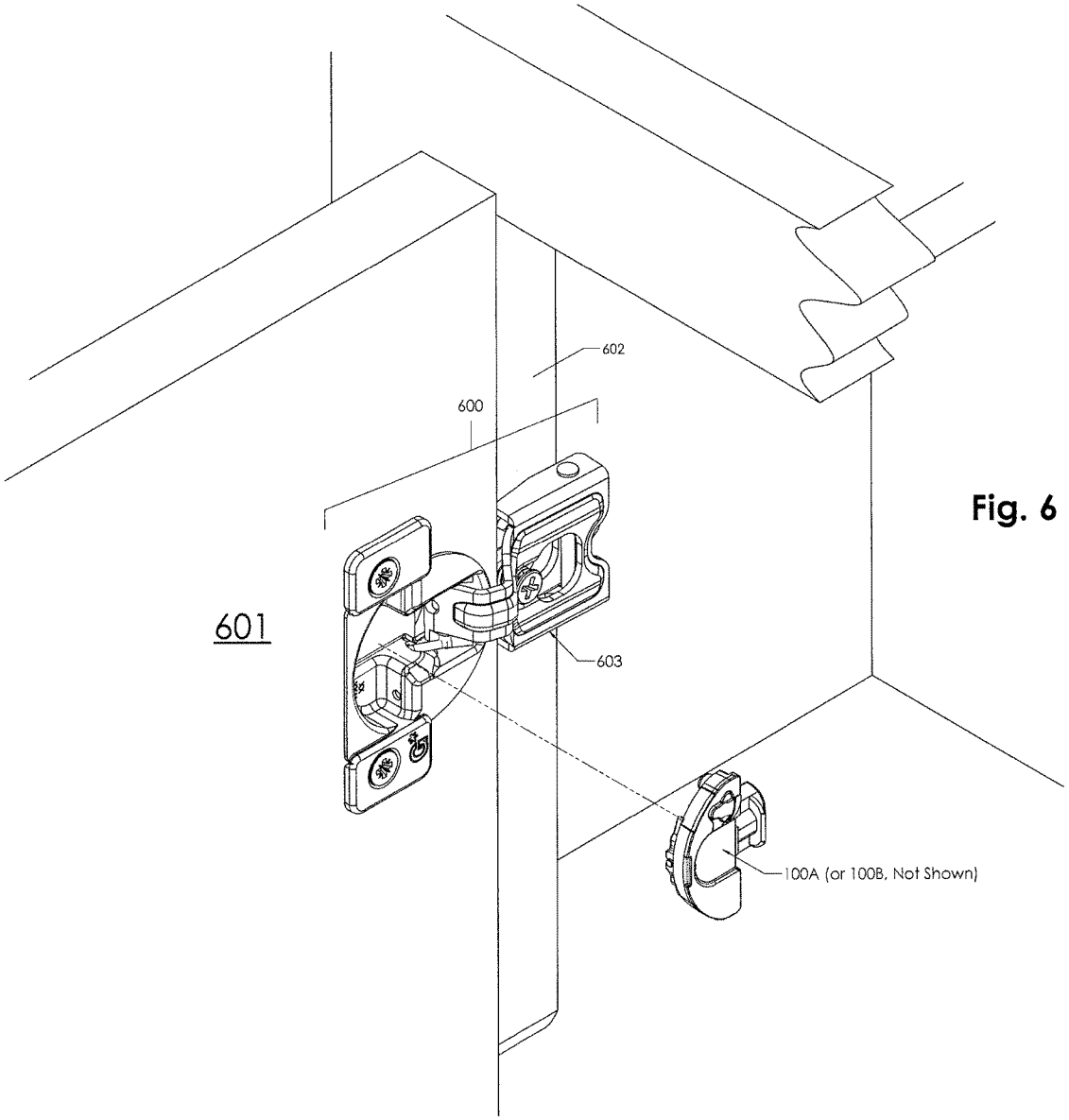
FIG. 6 is a perspective view of a cabinet hinge assembly 600 including a damping mechanism 100A or 100B according to either FIG. 2 or FIG. 4 inserted in and removably coupled to the hinge cup 4.

FIG. 6 shows the hinge assembly 600 for mounting a furniture door 601 to a furniture housing 602. The hinge assembly 600 includes a fixation section 603 installed on the furniture housing, a hinge cup 4 affixed to the furniture door 601 and pivotally connected to the fixation section 603, and a damping mechanism 100A or 100B provided in the hinge cup 4 and adapted to contact the fixation section 603 to dampen the relative movement between the fixation section 603 and the hinge cup 4 as the furniture door 601 closes on the furniture housing 602.

The damping mechanism 100A or 100B of the assembly 600 comprises an engagement mechanism adapted to mechanically couple the damping mechanism 100A or 100B to the hinge cup 4 in a removable manner. The engagement mechanism includes the recess/step 103*a*/102*b* of the damper cover 1 that engages the corresponding protrusion 41*a* provided on an inner surface 41 of the hinge cup 4, and the at least one connection member (10 or 11) of the damper cover assembly 1A, 1B that engages at least another portion (i.e., recesses/openings 41*b*) of the hinge cup 4 (see, e.g., FIGS. 3 and 5) to cooperatively couple the damping mechanism 100A or 100B to the hinge cup 4 of the hinge assembly 600.

In that manner, the damping mechanism 100A or 100B can be easily snap-fit into place in the hinge cup 4 using only hand-force and a simple tool or in connection with an automated assembly process. The damping mechanism 100A or 100B can also be readily removed from the hinge cup 4 by gently prying the rearward side 102 proximate the step 102*b*/recess 103*a* aera with a simple prying tool, using only hand-force and without damaging the damping mechanism 100A, 100B or the hinge cup 4.

LIST OF REFERENCE NUMBERS USED IN THE DRAWINGS

700: damping mechanism (prior art)
100A: damping mechanism ($1^{st}$ aspect)
100B: damping mechanism ($2^{nd}$ aspect)
- 1': prior art damper cover
- 112: integral/permanent protrusions
- 1A: damper cover assembly
  - 10: magnetic connection member(s)
- 1B: damper cover assembly
  - 11: clip-in, flex-tab connection member(s)
    - 11*a*: $1^{st}$ part/portion
    - 11*b*: $2^{nd}$ part/portion
    - 11*c*: $3^{rd}$ part/portion
    - 12: protrusion
- 1: damper cover (same for both 1A and 1B)
  - 101: frontward side
  - 101*a*: frontward side surface
  - 101*b*: frontward lateral side end
  - 101*c*: frontward lateral side end
  - 102: arcuate rearward side
  - 102*a*: rearward side surface
  - 102*b*: step
  - 103: upper/top surface
  - 103*a*: recess
  - 104: lower/bottom surface
  - 105: receptacle (for $1^{st}$ or $2^{nd}$ aspects)
  - 105*a*: receptacle opening
  - 105*b*: receptacle terminal end
  - 105*c*: receptacle inner surface
  - 109: damper switch
- 2: damping assembly
  - 202: piston lid
  - 203: balancing foam
  - 204: washer
  - 206: piston
  - 207: piston notch
  - 208: damper spring(s)
- 3: damper housing
- 4: hinge cup
  - 41: hinge cup interior wall
  - 41*a*: protrusion
  - 41*b*: recess

500A: hinge cup assembly ($1^{st}$ aspect)
500B hinge cup assembly ($2^{nd}$ aspect)
600: hinge assembly
- 601: furniture door
- 602: furniture housing
- 603: fixation section

What is claimed is:

1. A damping mechanism, comprising:

a damper housing;

a damping assembly provided within the damper housing; and a damper cover assembly fitted to at least a portion of the damper housing;

wherein the damper cover assembly comprises a damper cover and at least one connection member attached thereto, wherein the damper cover has a recess provided on a rearward side thereof, and at least one receptacle defining an opening on a bottom surface of the damper cover, and wherein the at least one receptacle is adapted to receive and retain therein at least a portion of the at least one connection member of the damper cover assembly, and wherein the recess of the damper cover and the connection member of the damper cover assembly are cooperatively adapted to provide a mechanical connection between the damping mechanism and a hinge cup of a hinge assembly in a removable manner.

2. The damping mechanism of claim 1, wherein the at least one connection member of the damper cover assembly comprises a magnet.

3. The damping mechanism of claim 1, wherein the at least one connection member of the damper cover assembly comprises a flex-tab.

4. A damping mechanism, comprising:

a damper housing;

a damping assembly provided within the damper housing; and a damper cover assembly fitted to at least a portion of the damper housing, the damper cover assembly comprising a damper cover and at least one connection member attached thereto, wherein the damper cover has an arcuate rearward side connecting two laterally opposed ends of a linear frontward side, an upper surface defining a plane extending in a first direction and an opposed lower surface extending in the first direction that is spaced apart from the first surface in a second direction that is substantially perpendicular with respect to the first direction;

wherein the upper surface of the damper cover includes a recess that is situated in a substantially central portion of the arcuate rearward side and which defines a step portion between the plane of the upper surface and a plane of a rearward surface the damper cover, wherein the damper cover includes at least one receptacle, extending in a second direction, which is substantially perpendicular with respect to the first direction, from an opening formed in the bottom surface toward a terminal end situated in an interior portion of the damper cover, the at least one receptacle of the damper cover assembly being situated proximate at least one of the laterally opposed ends of the frontward side of the damper cover, wherein the at least one receptacle of the damper cover assembly is adapted to receive and retain at least a portion of the at least one connection member of the damper cover assembly, and wherein the recess of the damper cover and the connection member of the damper cover assembly cooperatively define an engagement mechanism of the damper mechanism, whereby the damper mechanism is adapted to be connected to a hinge cup of a hinge assembly via the engagement mechanism in a removable manner.

5. The damping mechanism of claim 4, wherein the at least one connection member of the damper cover assembly comprises a magnet.

6. The damping mechanism of claim 4, wherein the at least one connection member of the damper cover assembly comprises a flex-tab.

7. The damping mechanism of claim 6, wherein the flex-tab of the damper cover assembly comprises a first portion adapted to be received and retained in the receptacle, a second portion, spaced apart from the first portion, that abuts a front surface of the damper cover, and a third portion connecting the first and second portions in a direction that is parallel with respect to the first direction.

8. The damping mechanism of claim 7, wherein the second portion of the flex-tab of the damper cover assembly comprises a protrusion extending a distance away from the front surface of the damper cover in the first direction.

9. The damping mechanism of claim 4, wherein the at least one receptacle of the damper cover assembly comprises two receptacles.

10. The damping mechanism of claim 9, wherein the at least one connection member of the damper cover assembly comprises two connection members.

11. The damping mechanism of claim 10, wherein the at least one connection member of the damper cover assembly comprises two magnets.

12. The damping mechanism of claim 10, wherein the at least one connection member of the damper cover assembly comprises two flex-tabs.

13. A hinge assembly for mounting a furniture door to a furniture housing, the hinge assembly comprising:

a fixation section installed on the furniture housing;

a hinge cup affixed to the furniture door and pivotally connected to the fixation section; and a damping mechanism, including a damper cover assembly, provided in the hinge cup and adapted to contact the fixation section to dampen the relative movement between the fixation section and the hinge cup as the furniture door closes on the furniture housing, wherein the damper cover assembly comprises an engagement mechanism adapted to mechanically couple the damping mechanism to the hinge cup in a removable manner, and wherein the damping mechanism comprises a damper housing, a damping assembly provided within the damper housing, and the damper cover assembly, fitted to at least a portion of the damper housing, wherein the damper cover has an arcuate rearward side connecting two laterally opposed ends of a linear frontward side, an upper surface defining a plane extending in a first direction and an opposed lower surface extending in the first direction that is spaced apart from the first surface in a second direction that is substantially perpendicular with respect to the first direction, wherein the upper surface of the damper cover includes a recess that is situated in a substantially central portion of the arcuate rearward side and which defines a step portion between the plane of the upper surface and a plane of a rearward surface the damper cover, wherein the damper cover includes at least one receptacle, extending in a second direction, which is substantially perpendicular with respect to the first direction, from an opening formed in the bottom surface of the damper cover toward a terminal end situated in an interior portion of the damper cover, the at least one receptacle of the damper cover being situated proximate at least one of the laterally opposed ends of the frontward side of the damper cover, wherein the at least one receptacle is adapted to receive and retain therein at least a portion of the at least one connection member of the damper cover assembly, and wherein the recess of the damper cover assembly engages a corresponding protrusion provided on an inner surface of the hinge cup and the at least one connection member of the damper cover assembly engages at least another portion of the hinge cup to cooperatively couple the damping mechanism to the hinge cup of the hinge assembly in a removable manner.

14. The damping mechanism of claim 13, wherein the at least one connection member of the damper cover assembly comprises a magnet.

15. The damping mechanism of claim 13, wherein the at least one connection member of the damper cover assembly comprises a flex-tab.

16. The damping mechanism of claim 15, wherein the flex-tab of the damper cover assembly comprises a first portion adapted to be received and retained in the receptacle, a second portion, spaced apart from the first portion, that abuts a front surface of the damper cover, and a third portion connecting the first and second portions in a direction that is parallel with respect to the first direction.

17. The damping mechanism of claim 16, wherein the second portion of the flex-tab of the damper cover assembly comprises a protrusion extending a distance away from the front surface of the damper cover in the first direction.

18. The damping mechanism of claim 13, wherein the at least one receptacle of the damper cover assembly comprises two receptacles.

19. The damping mechanism of claim 18, wherein the at least one connection member of the damper cover assembly comprises two connection members.

* * * * *